US009617810B2

(12) United States Patent
Smith et al.

(10) Patent No.: US 9,617,810 B2
(45) Date of Patent: Apr. 11, 2017

(54) DELIVERY METHOD AND SYSTEM

(71) Applicant: NAUTILUS MINERALS PACIFIC PTY LTD, Milton (AU)

(72) Inventors: Glen Smith, Milton (AU); Kenneth William Macleay, Belmont (AU); Paul William Nye, Christchurch (NZ)

(73) Assignee: NAUTILUS MINERALS PACIFIC PTY LTD, Milton (AU)

( * ) Notice: Subject to any disclaimer, the term of this patent is extended or adjusted under 35 U.S.C. 154(b) by 0 days.

(21) Appl. No.: 14/366,315

(22) PCT Filed: Oct. 31, 2012

(86) PCT No.: PCT/AU2012/001334
§ 371 (c)(1),
(2) Date: Jun. 18, 2014

(87) PCT Pub. No.: WO2013/090977
PCT Pub. Date: Jun. 27, 2013

(65) Prior Publication Data

US 2014/0332269 A1 Nov. 13, 2014

(30) Foreign Application Priority Data

Dec. 19, 2011 (AU) ..... 2011905289
Feb. 29, 2012 (AU) ..... 2012900798

(51) Int. Cl.

| | |
|---|---|
| ***E21B 7/12*** | (2006.01) |
| ***E21B 21/00*** | (2006.01) |
| ***E21B 7/128*** | (2006.01) |
| ***E21B 21/02*** | (2006.01) |
| ***E21B 27/00*** | (2006.01) |
| ***B63B 22/24*** | (2006.01) |
| ***B63B 35/28*** | (2006.01) |

(52) U.S. Cl.
CPC ..... *E21B 21/001* (2013.01); *B63B 22/24* (2013.01); *B63B 35/285* (2013.01); *E21B 7/12* (2013.01); *E21B 7/128* (2013.01); *E21B 21/02* (2013.01); *E21B 27/00* (2013.01)

(58) Field of Classification Search
CPC ..... E21B 7/12; E21B 7/124; E21B 41/0007
USPC ..... 166/358; 175/5, 6
See application file for complete search history.

(56) References Cited

U.S. PATENT DOCUMENTS 2,891,770 A * 6/1959 Bauer et al. ..... 175/7
3,839,914 A * 10/1974 Modisette et al. ..... 73/438
4,296,706 A 10/1981 Hughes
(Continued)

OTHER PUBLICATIONS

International Preliminary Report on Patentability and Written Opinion for Int. App. PCT/AU2012/001334, issued on Jun. 24, 2014.
(Continued)

*Primary Examiner* — Matthew R Buck
*Assistant Examiner* — Aaron Lembo
(74) *Attorney, Agent, or Firm* — McDonnell Boehnen Hulbert & Berghoff LLP

(57) ABSTRACT

A method for delivery of drilling fluid to a seafloor drilling assembly, the method comprising the steps of filling at least one container with drilling fluid; lowering the container through a body of water to adjacent a seafloor drilling assembly; connecting the container to the seafloor drilling assembly to deliver drilling fluid to the seafloor drilling assembly.

19 Claims, 7 Drawing Sheets

(56) References Cited

U.S. PATENT DOCUMENTS

| | | | | |
|---|---|---|---|---|
| 5,098,219 | A * | 3/1992 | Harrington | B63C 11/40 166/356 |
| 5,553,680 | A * | 9/1996 | Hathaway | 175/78 |
| 5,899,637 | A * | 5/1999 | Blanchard et al. | 405/210 |
| 6,062,313 | A | 5/2000 | Moore | |
| 6,179,071 | B1 | 1/2001 | Dietzen | |
| 6,571,876 | B2 * | 6/2003 | Szarka | 166/325 |
| 6,598,673 | B1 * | 7/2003 | Hosie et al. | 166/208 |
| 6,745,851 | B1 | 6/2004 | Edvardsen | |
| 6,796,379 | B1 * | 9/2004 | Martin | 166/356 |
| 7,027,968 | B2 * | 4/2006 | Choe et al. | 703/10 |
| 7,150,324 | B2 * | 12/2006 | Laursen et al. | 166/355 |
| 7,185,705 | B2 * | 3/2007 | Fontana | 166/356 |
| 7,261,164 | B2 * | 8/2007 | Hollier | 166/356 |
| 7,717,179 | B2 * | 5/2010 | Rayssiguier et al. | 166/285 |
| 7,794,527 | B2 * | 9/2010 | Sterner | 96/157 |
| 8,888,407 | B2 * | 11/2014 | Krecke | 405/64 |
| 9,010,435 | B2 * | 4/2015 | Matsur | 166/351 |
| 2003/0183393 | A1 | 10/2003 | Fincher et al. | |
| 2003/0217866 | A1 | 11/2003 | Deboer | |
| 2004/0168810 | A1 * | 9/2004 | Emmerson | 166/368 |
| 2005/0146137 | A1 * | 7/2005 | Davidson et al. | 285/322 |
| 2007/0277983 | A1 * | 12/2007 | Spiering et al. | 166/338 |
| 2009/0142594 | A1 | 6/2009 | Humphreys et al. | |
| 2010/0084190 | A1 * | 4/2010 | Eia et al. | 175/5 |

OTHER PUBLICATIONS

International Preliminary Report on Patentability for Int. App. PCT/AU2012/001334, mailed Jan. 24, 2014.

International Search Report for Int. App. No. PCT/AU2012/001334, completed Jan. 24, 2013.

* cited by examiner

DELIVERY METHOD AND SYSTEM

CROSS REFERENCE TO RELATED APPLICATIONS

The present application is a U.S. National Phase Application pursuant to 35 U.S.C. §371 of International Application No. PCT/AU2012/001334 filed Oct. 31, 2012, which claims priority to Australian Patent Application No. 2011905289 filed Dec. 19, 2011, and Australian Patent Application No. 2012900798 filed Feb. 29, 2012. The entire disclosure contents of these applications are herewith incorporated by reference into the present application.

FIELD OF THE INVENTION

This invention relates to a delivery method and associated system. In particular, the invention relates to a method and associated system for the delivery of drilling fluid to a seafloor based drilling assembly.

BACKGROUND OF THE INVENTION

The sea contains numerous different types of seafloor mineral deposits such as mineral sands, diamonds, rock phosphates, seafloor massive sulphides, nodules, and hydrates. Many of these deposits are located in deep water but at a relatively shallow depth below the seafloor. Accordingly, seafloor drill assemblies are being developed for sampling techniques (as opposed to vessel operated drilling rigs). Furthermore, seafloor drilling is also now being used for geotechnical evaluation. It is therefore important to achieve good quality and high recovery of core samples from below the seafloor.

Seafloor based drilling assemblies have many challenges that are required to be overcome. One of these challenges is how drilling fluid is provided to a seafloor drilling assembly while ensuring quality of the fluid is maintained. The benefits of using drilling fluids to assist while drilling holes to obtain core samples are well documented. Drilling fluids, also referred to as "drilling mud", are introduced through the drill string to facilitate the drilling process by removing cuttings, stabilizing the hole, improving penetration rates, enhancing core recovery and cooling and lubricating the coring bit and drill string. The delivery of drilling fluid is largely routine in surface based drilling, shallow water drilling or rig based drilling. However, the delivery of drilling fluid becomes more problematic in seafloor based drilling assemblies.

To date the only method of providing drilling fluid to the seafloor operated drilling assembly is to use a drilling fluid concentrate. This drilling fluid concentrate is mixed with sea water at the sea floor during the drilling operation using an inline mixer. Unfortunately, the subsequent mixed drilling fluid is often of inconsistent quality and the concentration and quantity required is often inadequate. Further, the measure of the quality of the drilling fluid is difficult to assess before use.

The reference to any prior art in this specification is not, and should not be taken as, an acknowledgement or any form of suggestion that the prior art forms part of the common general knowledge in Australia.

OBJECT OF THE INVENTION

It is an object of the invention to overcome or alleviate one or more of the disclosures or provide the consumer with the useful or commercial choice.

SUMMARY OF THE INVENTION

In one form, although not necessarily the only or broadest form, the invention relates to a method for delivery of drilling fluid to a seafloor drilling assembly, the method comprising the steps of:

filling at least one container with drilling fluid;

lowering the container through a body of water to adjacent a seafloor drilling assembly;

connecting the container to the seafloor drilling assembly to deliver drilling fluid to the seafloor drilling assembly.

The container may include a flexible reservoir. Preferably, the reservoir is collapsible. More preferably, the reservoir is a bladder.

The reservoir may be elongate. That is, the container may be at a smaller cross sectional area relative to its overall length. Further, the reservoir may be shaped to reduce drag as it is lowered through the body of water. For example, the ends of the reservoir may be tapered or conical.

A first hose may be connected to the reservoir. The first hose may be connected to adjacent a top of the reservoir. The first hose may be used to fill the reservoir with drilling fluid. Preferably, the first hose is of a sufficient length to enable the reservoir to be filled with drilling fluid without the reservoir being removed from the body of water. Typically a stab connection is provided on the first hose to enable the reservoir to be filled with drilling fluid.

A second hose may also be connected to the reservoir. The second hose may be connected to the bottom of the reservoir. The second hose may be used to connect the reservoir to the seafloor drilling assembly. Typically, a stab connection is used to connect the second hose to the seafloor drilling assembly.

Weights may form part of the container to enable controlled deployment of the container to the seafloor. The weights may be located on the reservoir and/or the second hose. The use of weights may be dependant on the specific gravity of the contained drilling fluid.

The container may include a weighted anchor. Preferably, the weighted anchor is attached to the bottom of the reservoir. Normally the weighted anchor is attached to the reservoir by a line such as a cable, tether, chain or the like.

The container may include a buoyancy device. Preferably, the buoyancy device is attached to the top of the reservoir. Normally the buoyancy device is attached to the reservoir by a line such as a cable, tether, chain or the like. The buoyancy device may be a buoyancy can. Typically the buoyancy device will be adapted to releasably attach to a winch line or the like.

A remotely operated vehicle may be used to connect the container to the seafloor drilling assembly. Preferably, the remotely operated vehicle may be used to connect a hose from the reservoir to the seafloor drilling assembly.

A lifting and lowering device is typically used to lower a container to adjacent the seafloor drilling assembly. The lifting and lowering device may be of any suitable form such as crane, winch or like device. Normally the lifting and lowering device is located on a ship, a barge or the like vessel.

Normally there are at least two lifting and lowering devices for lowering and lifting numerous containers. Each lifting and lowering device may be used to lift and lower a single container. The lifting and lowering devices may lift and lower their respective containers alternatively to minimize the time the seafloor drilling assembly is without drilling fluid.

A mixing and storage station may be used to mix drilling fluid. The mixing and storage station may be located on the same vessel as the lifting and lowering device. The mixing and storage station may include a mixing tank for mixing drilling fluid and a storage tank in which prepared drilling fluid is stored to facilitate additional shearing and hydration of the drilling fluid. An associated supply pump may be used to deliver the drilling fluid from the storage tank into the container. It should be appreciated that a single tank could be used for both the mixing and storage of the drilling fluid.

In another form, the invention resides in a system for delivering a drilling fluid to a seafloor drilling assembly, the system comprising:

a number of containers that are able to be filled with drilling fluid;

at least one lifting and lowering device attached to a platform, the lifting and lowering device able to be attached to the container; and a supply pump to pump drilling fluid into the container.

In yet another form, the invention resides in a container for transporting drilling fluid to a seafloor drilling assembly, the container comprising:

a reservoir for storing drilling fluid;

a first hose connected to the reservoir for filling the reservoir with drilling fluid; and a second hose connected to the reservoir for delivering fluid from the reservoir to a seafloor drilling assembly.

BRIEF DESCRIPTION OF THE DRAWINGS

An embodiment of the invention, by way of example only, will now be described with reference to the accompanying figures in which.

DETAILED DESCRIPTION OF THE PREFERRED EMBODIMENTS

Figure 1:
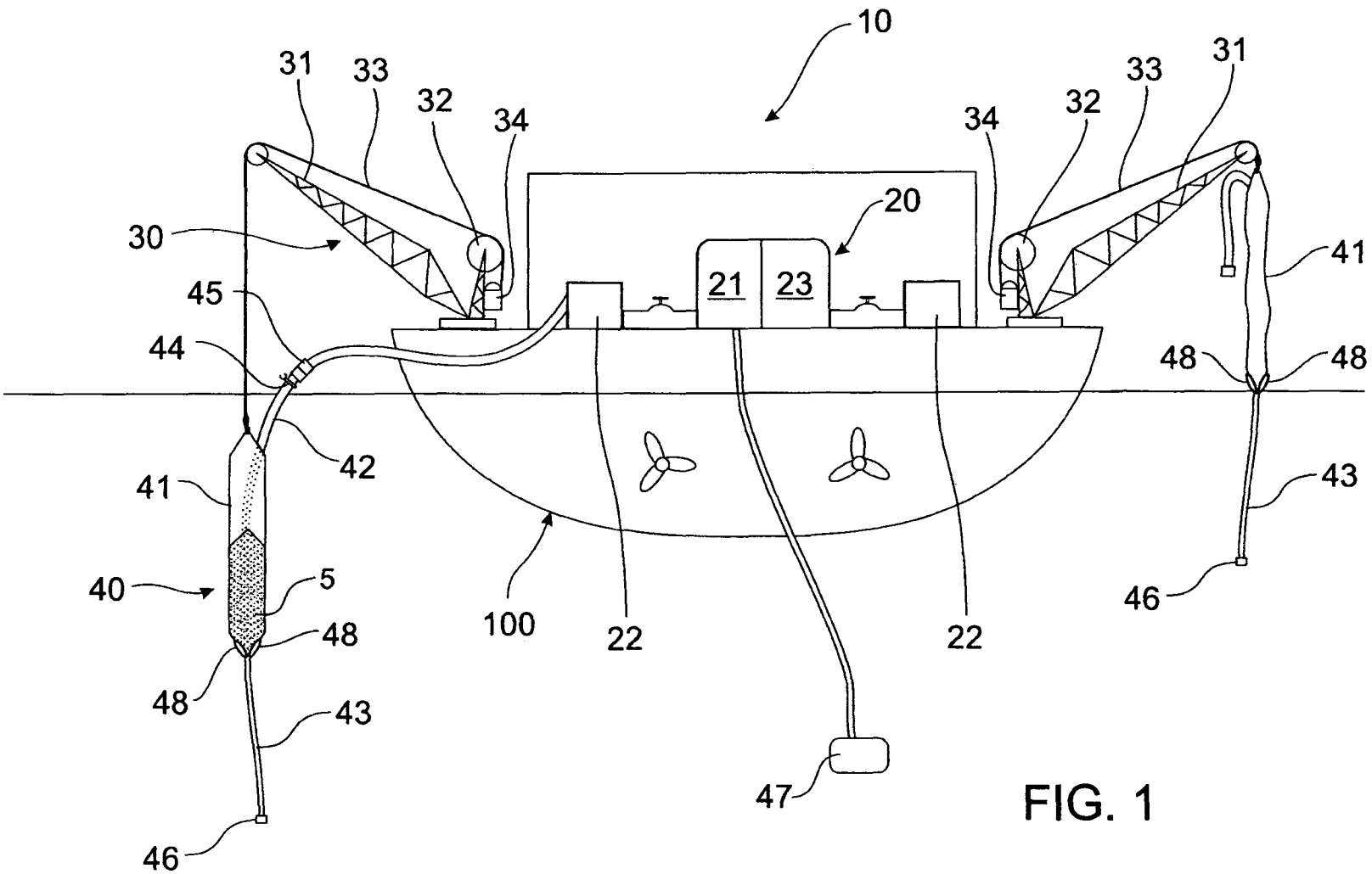
FIG. 1 is a schematic view of a system for delivering a drilling fluid to a seafloor drilling assembly in which a first container is being filled and a second container is being deployed.

FIGS. 1 to 6 show an embodiment of a delivery system 10 for delivering drilling fluid 5 to a seafloor drilling assembly 1. The delivery system 10 for delivering drilling fluid 5 includes a mixing and storage station 20, two cranes 30 and two containers 40.

The mixing and storage station 20 is mounted on a ship 100 and is used to mix drilling fluid 5 and supply the drilling fluid 5 into each of the containers 40. The mixing and storage station 20 includes a mixing tank 21 in which the drilling fluid 5 is mixed to the desired consistency, a storage tank 23 to store the mixed drilling fluid 5 and supply pumps 22 which are used to pump the drilling fluid 5 from the storage tank 23 into the containers 40.

The two cranes 30 are mounted on the ship 100 and are used to alternately lower and raise the containers 40 to the seafloor drilling assembly 1. The cranes 30 are standard cranes. Each crane 30 includes a boom 31, a cable reel 32 with an associated wire rope 33, and a motor assembly 34. Each wire rope 33 is attached to a respective container 40 with rotation of the cable reel 32 by the motor assembly 34 causing the container 40 to be raised and lowered by the crane 30.

The two containers 40 are connected to the wire rope 33 of respective cranes 30. Each of the containers 40 includes a reservoir 41, a filling hose 42 and a delivery hose 43. The reservoir 41 is in the form of a bladder. The bladder can be made from any suitable material to contain the associated drilling fluid 5. The reservoir 41 is elongate and has conical ends to enable the reservoir 41 to pass through water with minimal drag. Weights 48 are located adjacent the bottom of the reservoir 41 to assist in the controlled deployment of the container to the seafloor.

The filling hose 42 is attached to a top of the container 40 and is used to fill the reservoir 41 with drilling fluid 5. The filling hose 42 is able to be attached to the wire rope 33 via a clip 44 (or tie) when not in use. A coupling 45 is located on the end of the filling hose 42 to connect the filling hose 42 to the supply pump 22 of the mixing and storage station 20.

The delivery hose 43 is located on the bottom of the reservoir 41. The delivery hose 43 is used to deliver drilling fluid 5 from the reservoir 41 to the seafloor drilling assembly 1. A coupling 46 is located at the end of the delivery hose 43 to connect the delivery hose 43 to the seafloor drilling assembly 1. A remotely operated vehicle 47 is used to connect the delivery hose 43 to the seafloor drilling assembly 1.

Figure 2:
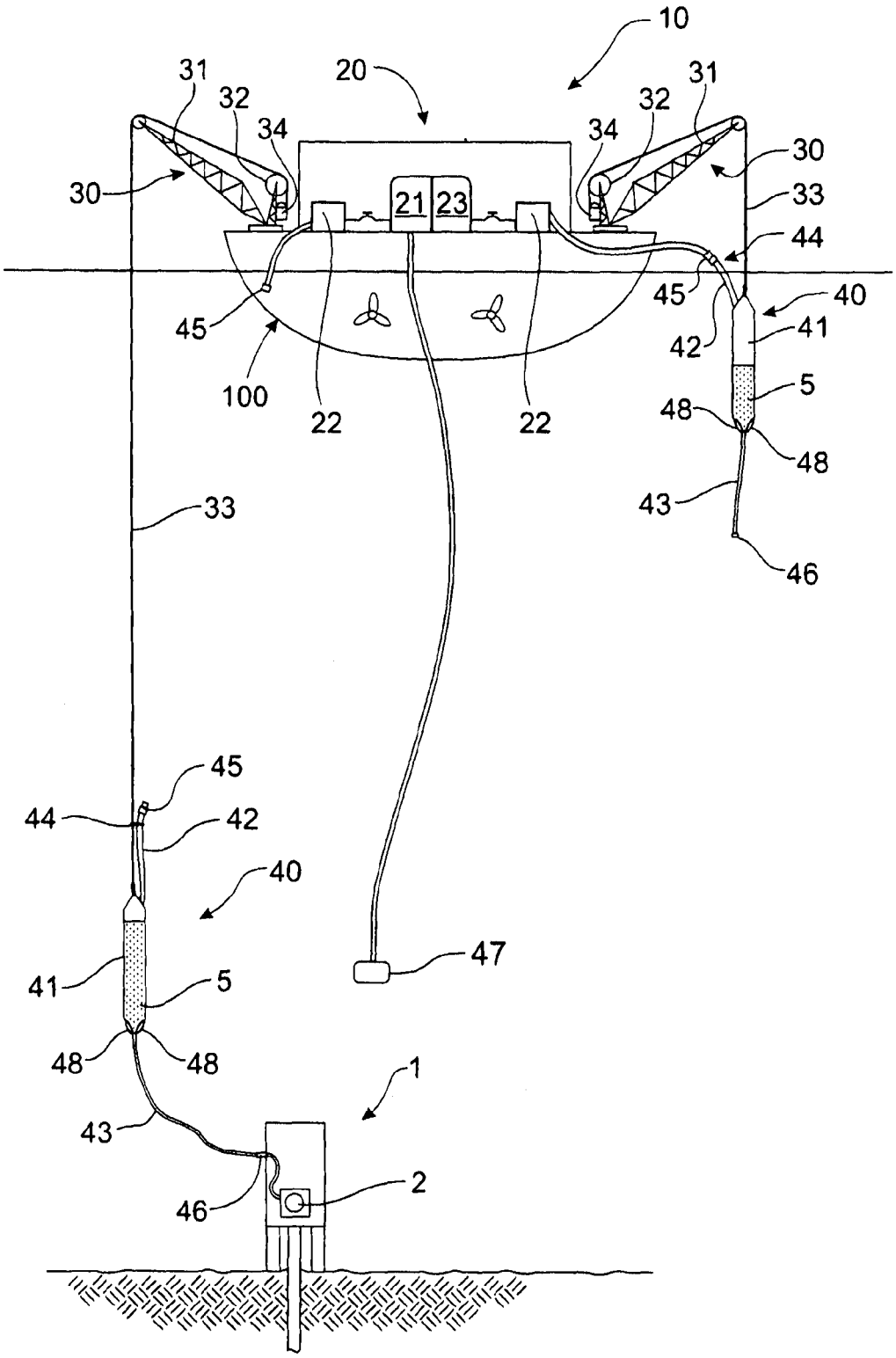
FIG. 2 is a schematic view of a system for delivering a drilling fluid to a seafloor drilling assembly in which the first container has been lowered adjacent to the seafloor drilling assembly and is commencing delivery of drilling fluid to the seafloor drilling assembly and the second container is being filled.
Figure 3:
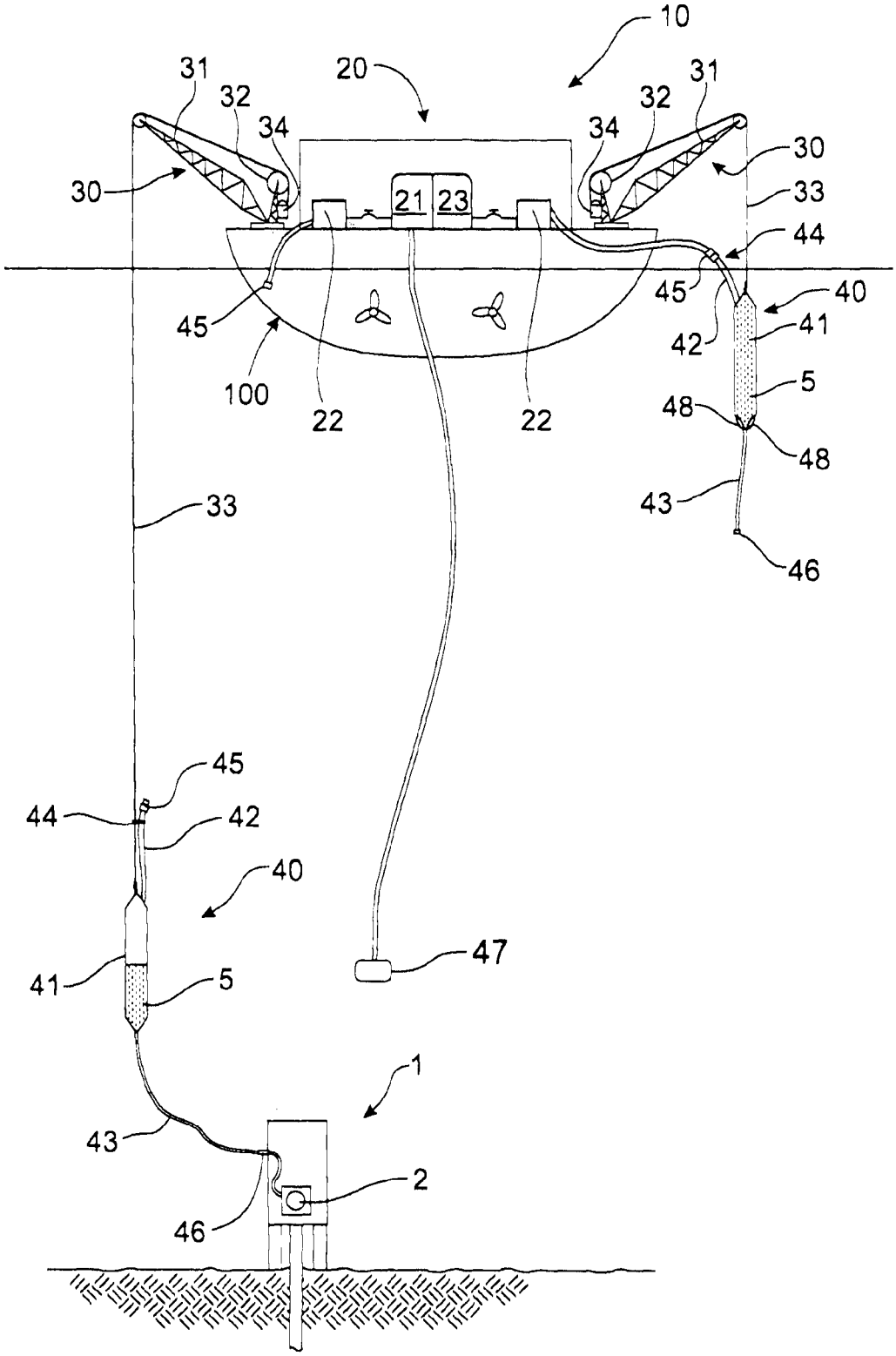
FIG. 3 is a schematic view of a system for delivering a drilling fluid to a seafloor drilling assembly in which the first container continues supplying drilling fluid to the seafloor drilling assembly and a second container has been filled.

In use, the ship 100 which carries the two cranes 30, mixing and storage station 20 and two containers 40 is positioned above the seafloor drilling assembly 1 as shown in FIG. 1. The containers 40 are connected to the wire ropes 33 of respective cranes 30. A first batch of drilling fluid 5 is mixed in the mixing tank 21 to a desired consistency and transferred to the storage tank 23. The filling hose 42 of one of a first container 40 is connected to the supply pump 22 of the mixing and storage station 20. The drilling fluid 5 is then pumped into the reservoir 41 of the first container 40 until the desired amount of drilling fluid 5 is located within the reservoir 41 as shown in FIG. 2. The filling hose 42 is then connected to the respective wire rope 33 using the clip 44. The motor assembly 34 of the crane 30 is then operated to rotate the wire rope reel 32 to lower the container 40 through the water until the container 40 is located adjacent to the seafloor drilling assembly 1. The remotely operated vehicle 47 is then used to connect the delivery hose 43 to the seafloor drilling assembly 1. A seafloor pump 2 which forms part of the seafloor drilling assembly 1, is then remotely operated to draw drilling fluid 5 from the reservoir 41 of the container 40 through the delivery hose 43 to be utilized by the seafloor drilling assembly 1 as shown in FIG. 3.

Figure 4:
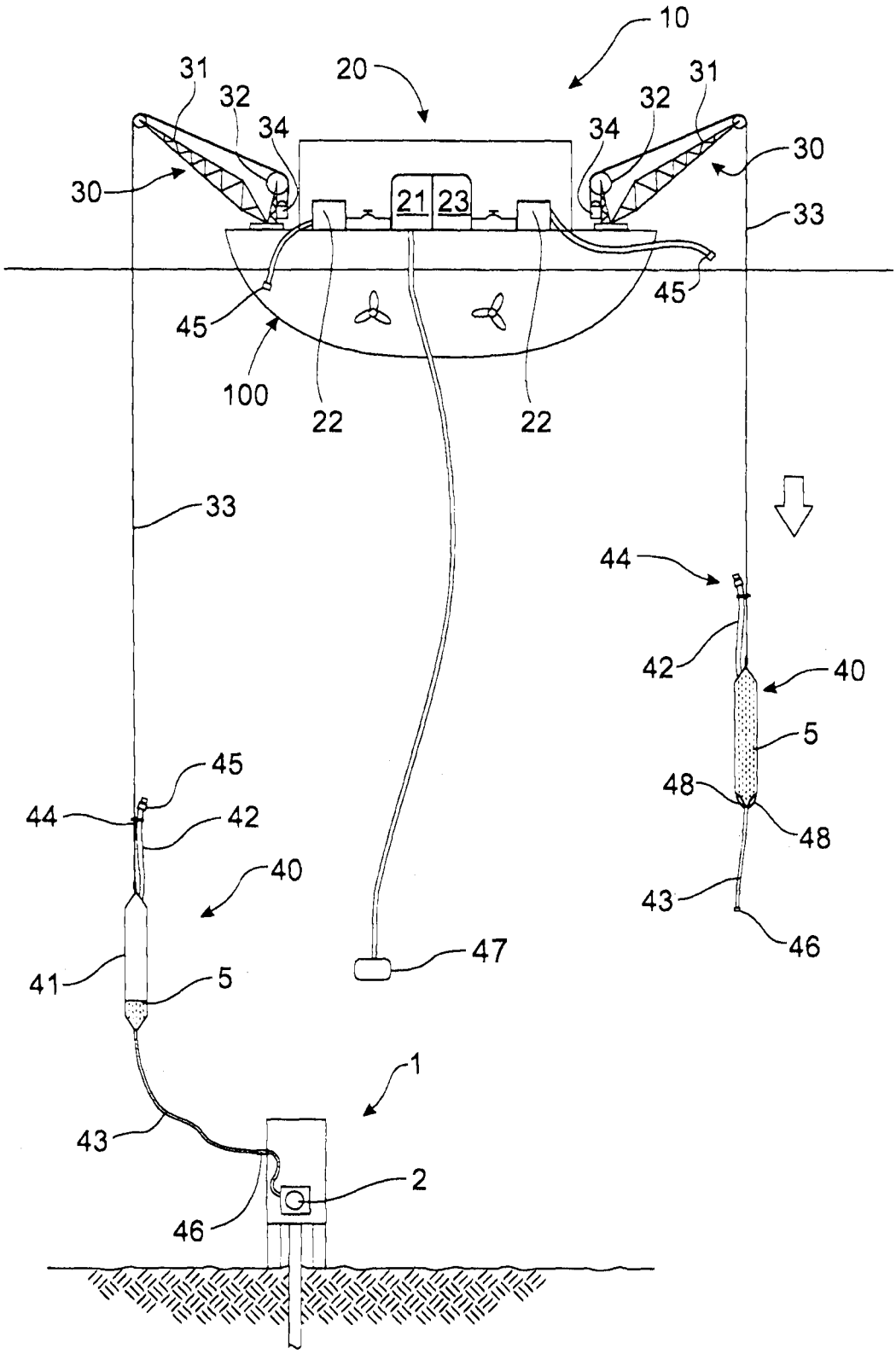
FIG. 4 is a schematic view of a system for delivering a drilling fluid to a seafloor drilling assembly in which the first container continues supplying drilling fluid to the seafloor drilling assembly and a second container is being lowered toward the seafloor drilling assembly.
Figure 5:
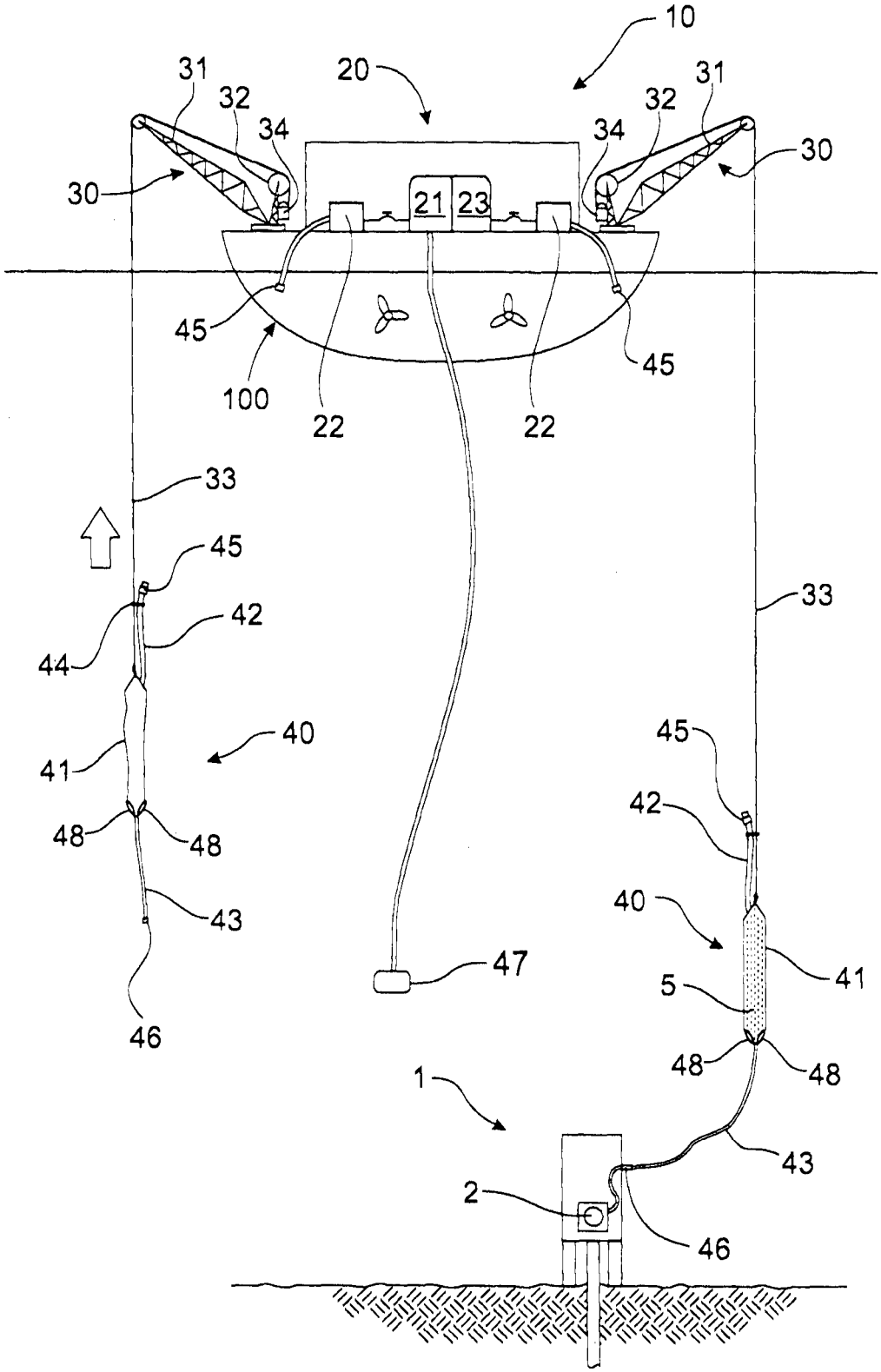
FIG. 5 is a schematic view of a system for delivering a drilling fluid to a seafloor drilling assembly in which the first container is being raised and the second container is commencing delivery of drilling fluid to the seafloor drilling assembly.

A further batch of drilling fluid 5 then is mixed in the mixing tank 21 of the mixing and storage station 20 and on reaching the desired consistency is transferred to the storage tank 23. The reservoir 41 of the second container 40 is then filled using the same steps as described above for the reservoir 41 of the first container 40. The timing of the filling of the second container 40 is based on the calculated emptying time of the first container 40. Accordingly, once the second container 40 has been filled it can be lowered to adjacent the seafloor drilling assembly 1 as shown in FIG. 4. When the first container 40 is emptied of drilling fluid 5, the delivery hose 43 of the first container 40 can be released from the seafloor drilling assembly 1 and the delivery hose 43 of the second container 40 is connected to the seafloor drilling assembly 1 as shown in FIG. 5. This ensures that the operation of the seafloor drilling assembly 1 is not stopped for any substantial period of time waiting for delivery of the drilling fluid 5.

Figure 6:
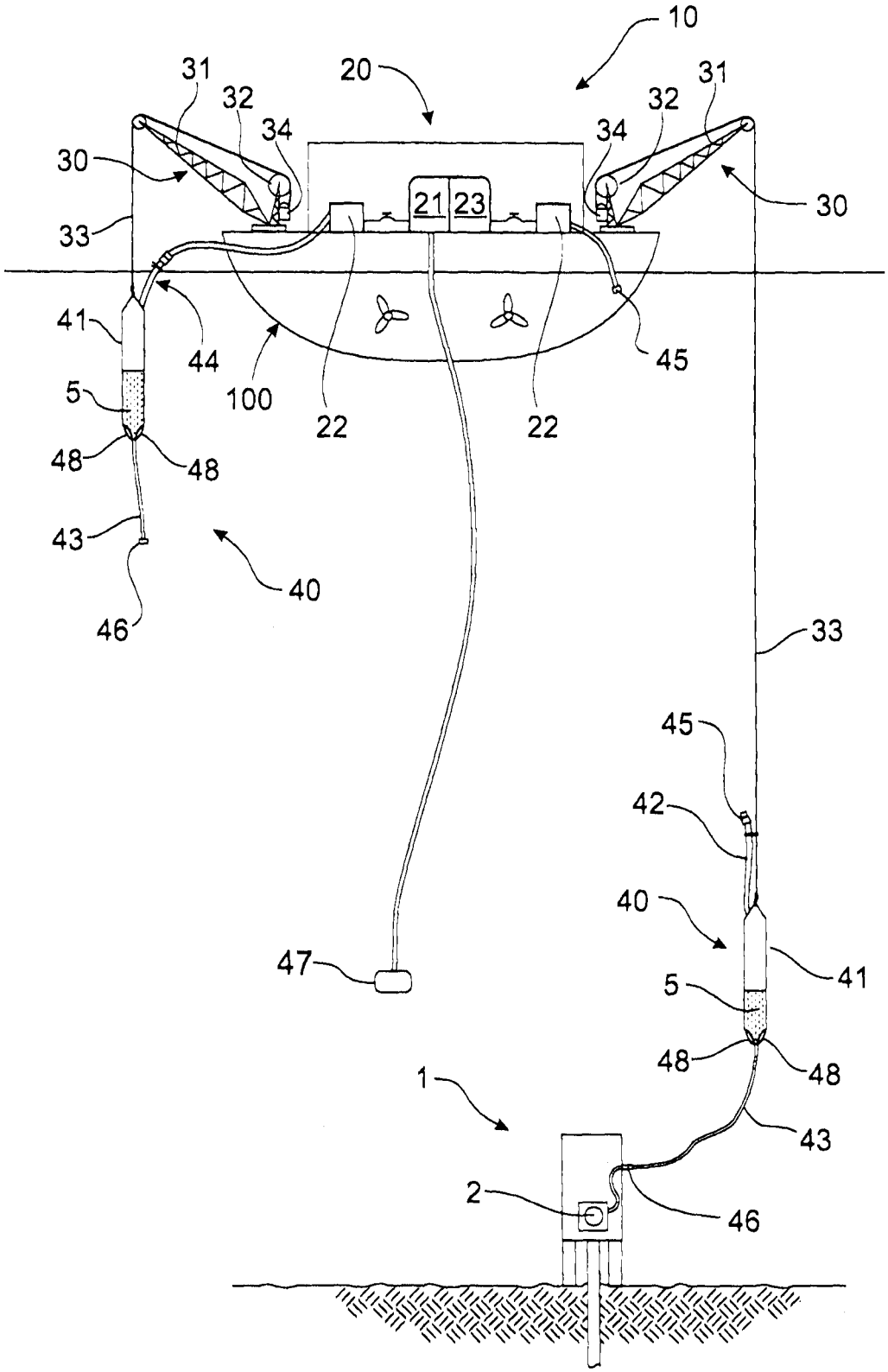
FIG. 6 is a schematic view of a system for delivering a drilling fluid to a seafloor drilling assembly in which the first container is being refilled and the second container continues supplying drilling fluid to the seafloor drilling assembly.

Once the delivery hose 43 of the first container 40 has been released from the seafloor drilling assembly 1, the first container 40 is able to be raised to adjacent the surface so that the reservoir 41 of the first container 40 is located beneath the water but the filling hose 42 is located above the water. In this regard, the reservoir 41 of the first container 40 can be quickly and easily filled without the need for the entire container 40 to be removed from the water and located on the ship 100 taking considerable time. Another batch of drilling fluid 5 is then prepared to fill the reservoir of the first container 40 as shown in FIG. 6. The process can then be repeated as desired.

Figure 7:
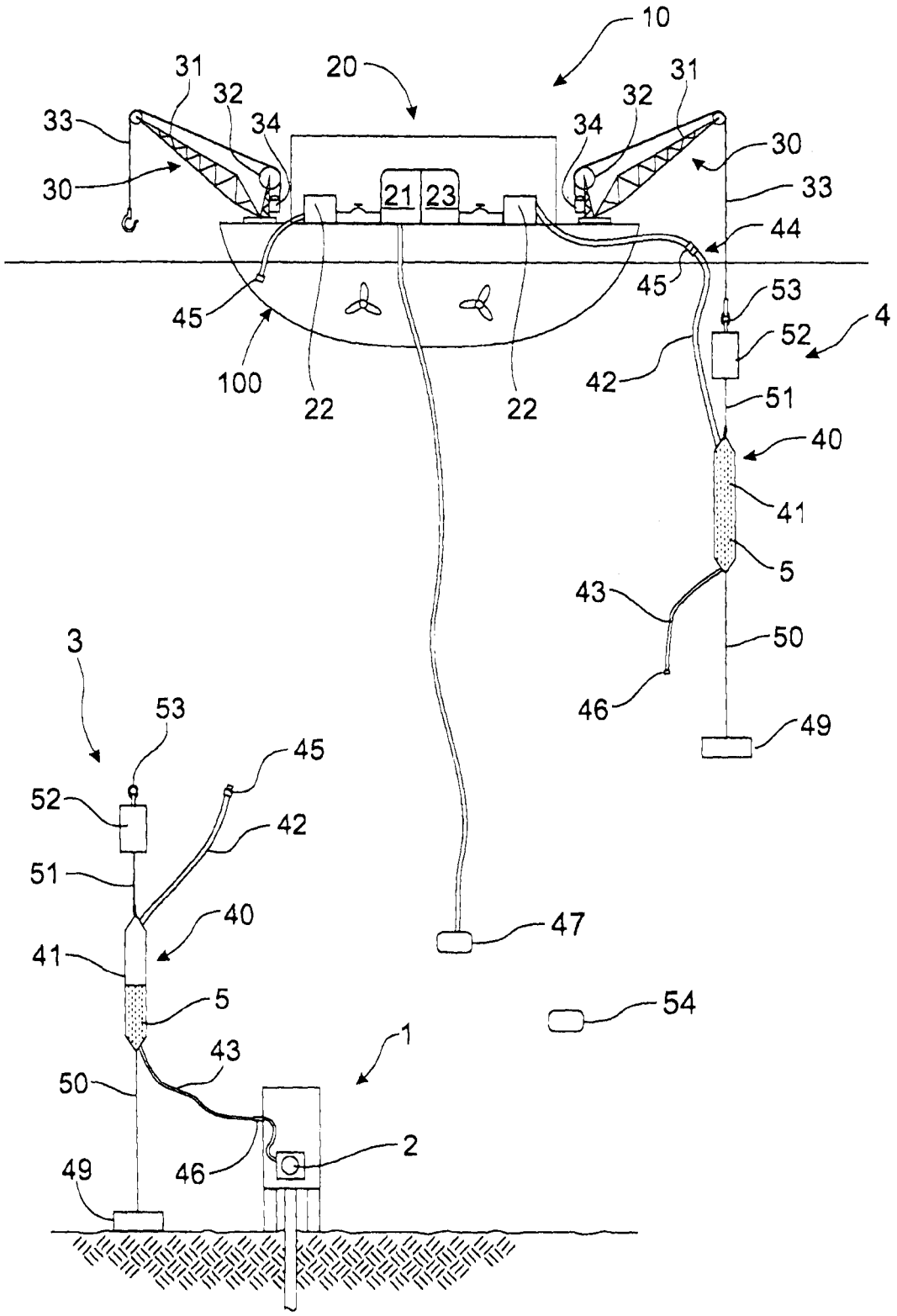
FIG. 7 is a schematic view of a system for delivering a drilling fluid to a seafloor drilling assembly in which a container includes a weight and a buoyancy device.

FIG. 7 shows a further embodiment of a container 40. Each of the containers 40 includes a reservoir 41, a filling hose 42, a delivery hose 43, a weight 49, a buoyancy device 52 and a lifting eye 53.

The reservoir 41 is in the form of a bladder. The bladder can be made from any suitable material to contain a drilling fluid 5.

The filling hose 42 is attached to a top of the reservoir 41 and is used to fill the reservoir 41 with drilling fluid 5. A coupling 45 is located on the end of the filling hose 42 to connect the filling hose 42 to a supply pump 22 of a mixing and storage station 20.

The delivery hose 43 is located on the bottom of the reservoir 41. The delivery hose 43 is used to deliver drilling fluid 5 from the reservoir 41 to a seafloor drilling assembly 1. A coupling 46 is located at the end of the delivery hose 43 to connect the delivery hose 43 to the seafloor drilling assembly 1.

The weight is in the form of an anchor weight 49, attached to the bottom of the reservoir 41 by a tether 50. The anchor weight 49 is adapted to maintain the position of the container 40 relative to the seafloor (see for example container 40 on the left side 3).

The buoyancy device is in the form of a buoyancy can 52, attached to the top of the reservoir 41 by a tether 51. The buoyancy can 52 is adapted to maintain the container 40 in an upright position (see for example container 40 on the left side 3).

The lifting eye 53 is attached to the top of the buoyancy can 52.

In use, a container 40 is attached to a wire rope 33 of a crane 30 by releasably attaching the wire rope 33 to the lifting eye 53. The container 40 is then lifted off the ship 100 and lowered into the water. The filling hose 42 is attached by the coupling 45 to the supply pump 22 of the mixing and storage station 20. Drilling fluid 5 is pumped by the supply pump 22 into the reservoir 41. Once the desired drilling fluid 5 has been pumped into the reservoir 41, the filling hose 42 is disconnected from the supply pump 22. The container 40 is then lowered to the seafloor using the wire rope 33.

Once the container 40 is in the desired location on the seafloor, the wire rope 33 is disconnected from the container 40. Once the wire rope 33 is disconnected, the wire rope 33 may be used to lower or raise another container (not shown). Disconnection of the wire rope 33 from container 40 allows for better management of equipment (for example disconnection of the wire rope 33 from container 40 and retraction of the wire rope 33 provides less possible interference with the operation of a remotely operated vehicle 47, seafloor drilling assembly 1 or umbilicals & cables associated with any subsea operations). Disconnection of wire ropes 33 from the containers 40 also allows for the ship 100 to move out of position (for example due to changing weather conditions) without having to raise the containers 40.

The remotely operated vehicle 47 is used to connect the delivery hose 43 to the seafloor drilling assembly 1 by the coupling 46. The drilling fluid 5 is then delivered to the seafloor drilling assembly 1 from the container 40.

Once the drilling fluid 5 has been delivered to the seafloor drilling assembly 1, the coupling 46 is released, disconnecting the delivery hose 43 from the seafloor drilling assembly 1.

The remotely operated vehicle 47 can be used to connect the wire rope 33 to the lifting eye 53 such that the container 40 can be brought back up towards the surface, either to be refilled with drilling fluid 5 or to be placed back onto the ship 100.

The delivery method and associated system enables drilling fluid of a desired consistency, quality and quantity to be reliably and safely delivered to a seafloor drilling assembly. The delivery method and associated system also enables the core drilling operations of the seafloor drilling assembly to continue with minimal time spent waiting on drilling fluid supply.

In this specification, the terms "comprise", "comprises", "comprising" or similar terms are intended to mean a non-exclusive inclusion, such that a system, method or apparatus that comprises a list of elements does not include those elements solely, but may well include other elements not listed.

It will also be appreciated that various other changes and modifications may be made to the invention described without departing from the spirit and scope of the invention.

The invention claimed is:

1. A method for delivery of drilling fluid to a seafloor drilling assembly, the method comprising the steps of:
   - connecting a first hose to a reservoir of at least one container;
   - filling the reservoir of the at least one container with drilling fluid;
   - lowering the container through a body of water to adjacent a seafloor drilling assembly;
   - connecting the container to the seafloor drilling assembly to deliver drilling fluid to the seafloor drilling assembly.

2. The method of claim 1, wherein the container includes a flexible reservoir.

3. The method of claim 1, wherein the reservoir is a bladder.

4. The method of claim 1, wherein the first hose is of a sufficient length to enable the reservoir to be filled with drilling fluid without the reservoir being removed from the body of water.

5. The method of claim 1, wherein a second hose is connected to the reservoir.

6. The method of claim 5, wherein the second hose is used to connect the reservoir to the seafloor drilling assembly.

7. The method of claim 1, wherein weights form part of the container to enable controlled deployment of the container to the seafloor.

8. The method claim 1, wherein the container includes a buoyancy device.

9. The method of claim 1, wherein a remotely operated vehicle is used to connect the container to the seafloor drilling assembly.

10. The method of claim 1, wherein a lifting and lowering device is used to lower the container to adjacent the seafloor drilling assembly.

11. The method of claim 1, wherein there are at least two lifting and lowering devices including a first lifting and lowering device for lowering and lifting the container and each further lifting and lower device for lowering and lifting a further respective container.

12. The method of claim 11, wherein the lifting and lowering devices may lift and lower their respective containers alternatively.

13. The method of claim 1, further comprising the step of mixing the drilling fluid in a mixing and storage station before delivering drilling fluid to a seafloor drilling assembly.

14. The method of claim 13, wherein the mixing and storage station includes a mixing tank and a storage tank.

15. The method of claim 14, wherein an associated supply pump is used to deliver the drilling fluid from the storage tank into the container.

16. A system for delivering a drilling fluid to a seafloor drilling assembly, the system comprising:

a number of containers that are able to be filled with drilling fluid;

at least one lifting and lowering device attached to a platform, the lifting and lowering device able to be attached to the container;

the lifting and lowering device being configured to deliver the container to the seafloor drilling assembly adjacent the seafloor; and a supply pump located on the platform to pump drilling fluid into the container at or adjacent to the platform.

17. The system of claim 16, further including a mixing and storage station located on the platform, wherein the mixing and storage station is configured to mix the drilling fluid before the containers are filled.

18. A container for transporting drilling fluid to a seafloor drilling assembly, the container comprising:

a reservoir for storing drilling fluid;

a first hose connected to the reservoir for filling the reservoir with drilling fluid; and a second hose connected to the reservoir for delivering fluid from the reservoir to a seafloor drilling assembly;

wherein the container is configured to deliver the drilling fluid to the seafloor drilling assembly adjacent to the seafloor.

19. The container of claim 18, wherein weights form part of the container to enable controlled deployment of the container to the seafloor.

* * * * *